United States Patent [19]

Haft

[11] 4,217,675

[45] Aug. 19, 1980

[54] RETRACTABLE WHEEL ASSEMBLY FOR LUGGAGE

[76] Inventor: Theodore Haft, 3844 Carrel Blvd., Oceanside, N.Y. 11572

[21] Appl. No.: 50,968

[22] Filed: Jun. 22, 1979

[51] Int. Cl.[3] ..... B60B 33/04

[52] U.S. Cl. ..... 16/19; 190/18 A; 280/37

[58] Field of Search ..... 16/19, 18 R; 190/18 A; 280/35, 37, 79.1

[56] References Cited

U.S. PATENT DOCUMENTS

| | | | |
|---|---|---|---|
| 3,842,953 | 10/1974 | Royet | 190/18 A |
| 4,026,569 | 5/1977 | Staal | 280/37 |

*Primary Examiner*—Doris L. Troutman
*Attorney, Agent, or Firm*—Edward H. Loveman

[57] ABSTRACT

A retractable wheel assembly for an article of luggage has a housing formed with side and end walls, closed top and open bottom. The housing fits into an opening in a side of the luggage and has a peripheral flange for attachment to the luggage. The housing has a well in which is a fork supporting a rotatable wheel. The fork is rotatable on a stationary pin and is movable laterally on the pin. A coil spring on the pin biases the fork against an abutment in the well so the fork and wheel are held retracted in the well. A catch cooperates with the spring in holding the fork and wheel retracted. When the catch is disengaged the fork can be rotated on the pin to an outward position where the coil spring moves the fork laterally into engagement with a flat, U-shaped bracket at the bottom of the housing. There the fork is held extended until moved manually laterally against the bias of the spring to disengage the fork from the bracket, so that the fork and wheel can be rotated into the well. The catch may be a manually rotatable lug or a spring catch member. THe axis of rotation of the fork is perpendicular to the axis of rotation of the wheel in the fork so the wheel may retract entirely into the well.

10 Claims, 5 Drawing Figures

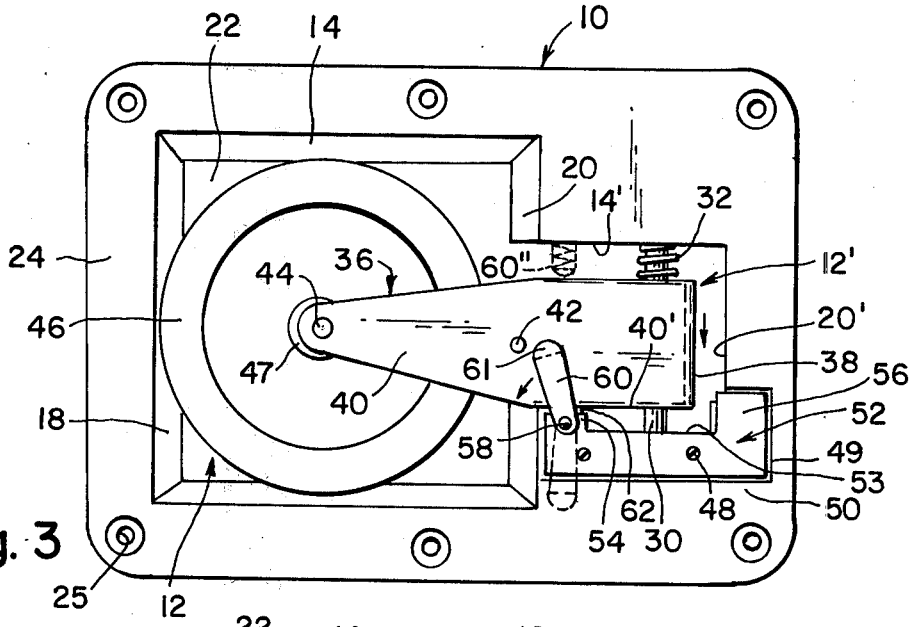
Fig. 3
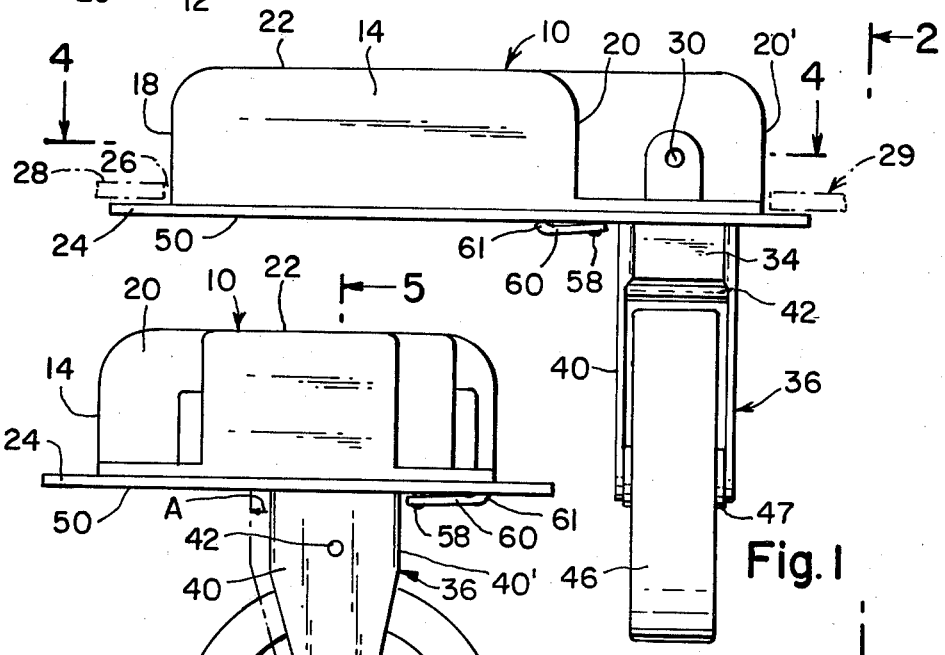
Fig. 1
Fig. 2

RETRACTABLE WHEEL ASSEMBLY FOR LUGGAGE

This invention concerns a wheel assembly for an article of luggage such as a suitcase, trunk or the like, adapted to be secured to luggage and arranged to support a freely rotatable wheel in retracted and extended positions selectively.

Retractable wheel assemblies heretofore known have employed a wheel supported by a fork, wherein the fork is rotatable on an axis to retract and extend the wheel. In these prior wheel assemblies, a spring is provided to assist in retracting the wheel, and to assist in holding the wheel fork in place when the wheel is extended. The force of the spring is exerted in a direction perpendicular to the axis of rotation of the wheel, and the fork is extended by rotation on an axis parallel to the axis of rotation of the wheel. This construction leads to several difficulties in operation. For example, extension of the wheel and supporting fork requires considerable exertion to extend the retention spring. If the spring is stiff this operation is difficult to perform. If the spring stretches and weakens in time, the retracted wheel falls into the extended position when it should be retracted, and the wheel is not securely held in the extended position by the weak spring. Another disadvantage is the number and complexity of parts required for the wheel assembly. In some prior wheel assemblies, the wheel cannot be fully retracted and a part always extends from the assembly.

The present invention is directed at overcoming the above and other difficulties and disadvantages of prior retractable wheel assemblies. According to the invention, the wholly retracted wheel and supporting fork are held in retracted position in a well in a housing by a suitable catch. When the catch is disengaged, the fork is rotated on an axis perpendicular to the aixis of the rotation of the wheel in the fork. When the fork reaches a fully extended position, it is moved laterally by a compressed coil spring and is engaged in a recess in a retention bracket mounted on the housing. This bracket holds the fork and wheel extended so that they cannot accidently be retracted. Retraction of the wheel and fork is accomplished by manually moving the extended bracket laterally against bias of the coil spring to disengage the fork from the bracket. Then the bracket rotates freely into the well in the housing, and is held there by the coil spring in cooperation with the catch. The construction of the wheel assembly is simpler than prior retractable wheel assemblies. The wheel is more fully concealed in retracted position. The fork is easier to move to extended position, and is more securely held in the retracted position by cooperation of the coil spring and the catch.

It is therefore a principal object of the present invention to provide a retractable wheel assembly comprising a wheel and fork assembly in a housing of a suitcase.

It is another object of the present invention, to provide a wheel and fork assembly of the type described wherein the fork is extended from said housing by rotation on an axis perpendicular to the axis of rotation of the wheel.

It is still another object of the present invention to provide a wheel and fork assembly of the type described wherein the force from a coil spring is utilized to laterally move the fork into a recess of a retention bracket when the fork is in the extension position.

These and other objects and many of the attendant advantages of this invention will be readily appreciated as the same becomes better understood by reference to the following detailed description when considered in connection with the accompanying drawings in which:

FIG. 1 is a side elevational view of a retractable wheel assembly embodying the present invention, with wheel and wheel fork shown extended from the housing;

FIG. 2 is an end elevational view taken along line 2—2 of FIG. 1;

FIG. 3 is a bottom plan view of the wheel assembly with wheel and fork retracted into the housing;

Figure 4:
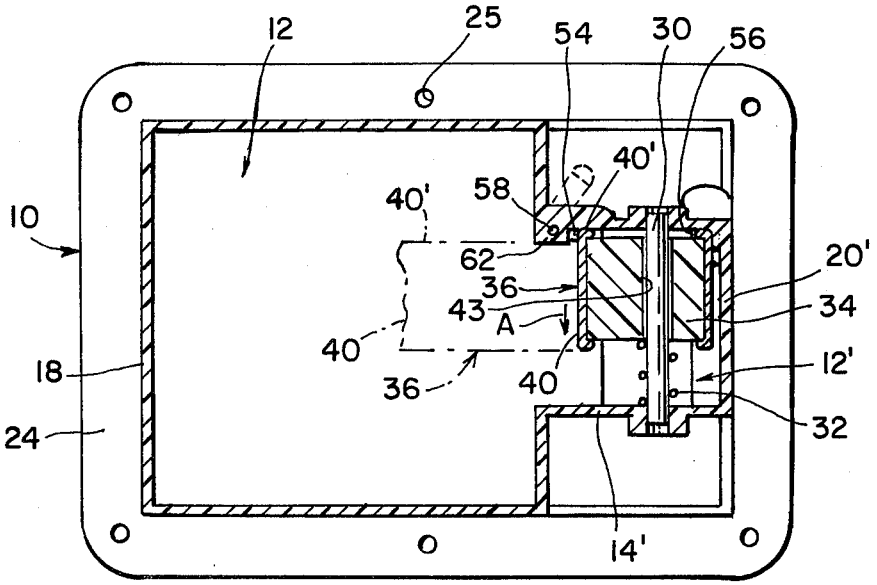
FIG. 4 is a horizontal cross sectional view taken along line 4—4 of FIG. 1.
Figure 5:
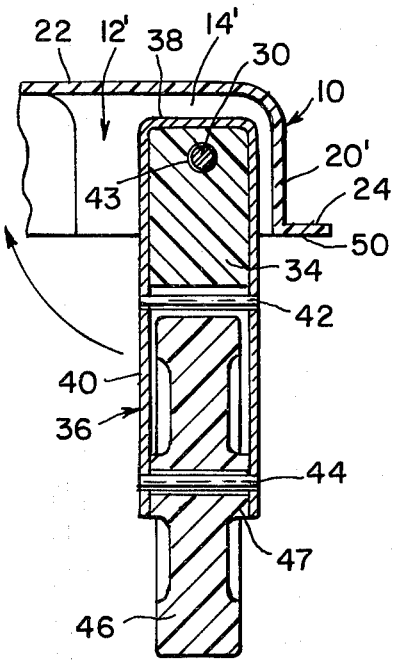
FIG. 5 is a vertical sectional view taken along line 5—5 of FIG. 2.

Referring now to the drawings wherein like reference characters designate like or corresponding parts throughout, there is illustrated in FIGS. 1 to 5 a retractable wheel and fork assembly having a generally rectangular housing 10 formed with an internal well 12 defined by side walls 14, end wall 18 and opposite end wall 20. The well 12 has an extension 12′ defined by short side walls 14′ and short end walls 20′. The well 12 has a closed top wall 22, so that the housing 10 is entirely open at the bottom. A flat, rectangular flange 24 surrounds the well 12 and is provided with holes 25 to receive bolts or rivets for attaching the housing 10 to an article of luggage. For example, the housing 10 may be inserted and secured by rivets in an opening 26 in a wall or side 28 of an article of luggage 29 indicated by dotted lines in FIG. 1.

Extended across the well extension 12′ is a stationary pin or shaft 30. Opposite ends of the pin 30 are secured in the side walls 14′. On this pin 30 is a coil spring 32. Rotatably mounted on the pin 30 is a block 34 secured at the closed end of a rectangular U-shaped bifurcated fork 36 which has a flat bight 38 overlaying the block 34 as shown best in FIG. 5. Flat sides of legs 40 of the fork 36 abut sides of the block 34. A rivet pin 42 extends through the fork 36 under the block 34, and opposite ends of the pin 30 are secured in sides 40 of the fork 36 to keep the block 34 secured in place in the fork 36; see FIG. 5.

The pin or shaft 30 extends through a bore 43 in the block 34. Another pin 44 is disposed parallel to the pin 42 and perpendicular to the pin 30. The pin 44 extends across the fork 36 and is anchored at its ends in the sides 40, of the fork 36. The pin 44 serves as a stationar axle which carries a freely rotatable wheel 46. The wheel 46 is formed with axially extending hubs 47 which serve as spacers against the sides 40 of the fork 36. The wheel 46 is narrower than the distance separating the sides 40 of the fork 36 so that the wheel 46 rotates freely on its central axis through which the axle 44 extends.

Mounted by screws 48 in a recess 49 in the flat bottom 50 of the housing 10 is a flat rectangular U-shaped bracket 52. This bracket has a flat short arm 54 and a longer arm 56. Adjacent the arm 54 is a pin 58 holding a rotatable lug 60 which serves as a catch as will be hereinafter described.

FIG. 3 shows the wheel 46 and the fork 36 in a retracted position in the wells 12, 12′. In this position the coil spring 32 is compressed and holds the edges 40′ of the side walls 40 against a projection or abutment 62 in the well extension 12′; see FIG. 4. In addition, the catch member 60 is rotated so that its bent end 61 abuts and overlays the outer side 40 of the fork 36. Thus the catch member 60 and the spring 32 cooperate in holding the wheel 46 wholly retracted in the housing 10. The plane of the wheel 46 is then parallel to the plane of the housing top wall 22.

The catch member 60 can be rotated on the pin 58 about 170° to the dotted line position shown in FIG. 3 so that its bent end 61 bears on the bottom of the housing 10, clearing the well extension 12' and disengaging the fork 36. The fork 36 and the wheel 46 can then be grasped and rotated on the pin or shaft 30 to extend the fork 36 and the wheel 46 to the position shown in FIGS. 1, 2, 4, and 5. When the fork 36 and the wheel 46 reach their fully open position, the spring 32 expands slightly and moves the fork 36 and the block 34 laterally along the pin 30. This moves the fork 36 into the recess 53 in the bracket 52. The fork 36 is then prevented from rotation on the pin 30 by abutment of its opposite sides or legs against the edges of the arms 54 and 56 of the bracket 52 as best shown in FIG. 4.

To close or retract the wheel 46 and the fork 36, the block 34 and the fork 36 are moved in a direction shown by arrow A in FIGS. 2 and 4, parallel to the sides 40 of the fork 36 against the bias of the spring 32 to disengage the edges 40' of the fork 36 from the arms 54 and 56 of the bracket 52. Then the fork 36 may be freely rotated on the pin 30 to the retracted position shown in FIG. 3 where the spring 32 will again hold the fork 36 against the abutment 62. The catch 60 can then be rotated to the solid line holding position shown in FIG. 3, to retain the fork 36 and the wheel 46 in retracted position in the well 12, 12'.

If desired, the catch 60 can be replaced by a spring catch 60" shown by dotted lines in FIG. 3 disposed in the well 12' of the housing 10. This spring catch will engage the fork 36 and hold it retracted in cooperation with the compressed coil spring 32. The spring catch 60" provides the advantage that the catch 60" does not project beyond the plane of housing bottom 50, and it operates automatically to engage and release the fork 36 with a snap or detent action.

The housing and wheel can be made of molded plastic, while other parts may be made of metal or plastic as expedient. The assembly is characterized by its relative simplicity of construction and easy and foolproof operation. It can readily support a heavy trunk, suitcase or other article of luggage. If desired it can be installed in any suitable type of container to enable easy portability, and it can quickly and easily be retracted out of the way when desired.

It should be understood that the foregoing relates to only a preferred embodiment of the invention which has been by way of example only and that it is intended to cover all changes and modifications of the example of the invention herein chosen for the purposes of the disclosure, which do not constitute departures from the spirit and scope of the invention.

What is claimed is:

1. A retractable wheel assembly for an article of luggage or the like, comprising:

a housing attachable to said article of luggage and having walls defining a well, closed top and open bottom;

a wheel support having a pair of spaced flat legs;

a wheel rotatably mounted on its axis between said legs;

shaft means in said well rotatably carrying said wheel support, said wheel support being freely movable laterally on said shaft means;

bracket means carried by said housing and arranged to engage said wheel support when in outwardly extending position; and spring means in said well arranged to urge said wheel support into engagement by said bracket means when in outwardly extended position, whereby said wheel support can be disengaged from said bracket means by moving said wheel support laterally on said shaft means against bias in said spring means, and whereby said wheel support can be rotated into said well when disengaged from said bracket means.

2. A retractable wheel assembly as defined in claim 1, further comprising catch means arranged to hold said wheel support and wheel in retracted position in said well.

3. A retractable wheel assembly as defined in claim 2, wherein said shaft means is a pin anchored in said walls of said housing, and wherein said spring means is a coil spring engaged on said pin.

4. A retractable wheel assembly as defined in claim 3, wherein said pin is disposed axially perpendicular to said axis of rotation of said wheel, so that said wheel is wholly disposed inside said well substantially parallel to said closed top thereof when said wheel is retracted into said well.

5. A retractable wheel assembly as defined in claim 3, wherein said catch means is a lug rotatably mounted on said housing and arranged to bear against a side of said fork when said fork is retracted in said well.

6. A retractable wheel assembly as defined in claim 3, wherein said catch means is a spring loaded catch mounted on a wall of said housing in said well and arranged to cooperate with said coil spring in holding said fork and wheel retracted in said well.

7. A retractable wheel assembly as defined in claim 3, wherein said housing is formed with peripherally extending means arranged for attachment to a side of said article of luggage with said walls wholly disposed inside said article of luggage.

8. A retractable wheel assembly as defined in claim 3, wherein said housing is formed with an abutment against which said wheel support is held in said well by said coil spring in cooperation with said catch means.

9. a retractable wheel assembly as defined in claim 3, wherein said wheel support is a rectangular U-shaped fork, said legs defining opposite spaced sides of said fork, said fork further having an end bight connecting said legs.

10. A retractable wheel assembly as defined in claim 9, further comprising a block disposed between said legs at said bight, said block having a bore through which said pin extends for rotatably supporting said wheel support.

* * * * *